US010238191B2

(12) United States Patent
Shurie

(10) Patent No.: US 10,238,191 B2
(45) Date of Patent: Mar. 26, 2019

(54) UMBRELLA WITH ENVIRONMENTAL CONTROL SYSTEMS

(71) Applicant: Jaffer Shurie, Silver Spring, MD (US)

(72) Inventor: Jaffer Shurie, Silver Spring, MD (US)

( * ) Notice: Subject to any disclaimer, the term of this patent is extended or adjusted under 35 U.S.C. 154(b) by 0 days.

(21) Appl. No.: 15/616,219

(22) Filed: Jun. 7, 2017

(65) Prior Publication Data

US 2018/0352922 A1 Dec. 13, 2018

(51) Int. Cl.
*A45B 25/00* (2006.01)
*B05B 15/00* (2018.01)

(52) U.S. Cl.
CPC ..... *A45B 25/00* (2013.01); *A45B 2025/003* (2013.01); *A45B 2200/1009* (2013.01); *A45B 2200/1036* (2013.01); *A45B 2200/1045* (2013.01); *B05B 15/00* (2013.01)

(58) Field of Classification Search
CPC ..... A45B 2200/1036; A45B 2200/1045
See application file for complete search history.

(56) References Cited

U.S. PATENT DOCUMENTS 3,739,792 A * 6/1973 Holland ..... A45B 3/00 135/16
5,207,238 A * 5/1993 Rivera ..... A45B 3/00 135/16
5,349,975 A * 9/1994 Valdner ..... A45B 3/00 135/16
6,298,866 B1 * 10/2001 Molnar, IV ..... A45B 3/00 108/50.12
6,612,713 B1 * 9/2003 Kuelbs ..... A45B 3/00 362/102
6,886,759 B1 * 5/2005 Okronick ..... A45B 3/00 239/16
7,104,270 B2 * 9/2006 Dong ..... A45B 3/00 135/16
7,322,208 B1 * 1/2008 Griffin ..... A45B 3/00 135/16
7,412,984 B1 * 8/2008 Spencer ..... A45B 3/00 135/16
7,575,008 B1 * 8/2009 Casey ..... A45B 3/00 135/16

(Continued)

*Primary Examiner* — David R Dunn
*Assistant Examiner* — Danielle Jackson
(74) *Attorney, Agent, or Firm* — Ingenium Patents LLC; Peter F. Kramer

(57) ABSTRACT

An umbrella with environmental control systems uses an environmental control system, an electrical control system (ECS), and a fluid delivery system to modify the local environment beneath the umbrella's canopy. The environmental control system has multiple spray nozzles, multiple fans, and multiple heating elements. The spray nozzles mist water onto the user, the fans blow air onto the user, and the heating elements heat up the air beneath the umbrella's canopy. To accomplish this, all of the components of the environmental control system are arranged advantageously beneath the umbrella's canopy. The umbrella has a handle, a support rod, multiple rib members, and a canopy. The support rod acts as a rigid connection channel through which the hoses that connect the spray nozzles to the fluid delivery system run. The ECS is the system that enables the user to selectively activate the various electrical components of the environmental control system.

8 Claims, 8 Drawing Sheets

(56) References Cited

U.S. PATENT DOCUMENTS

| | | | | |
|---|---|---|---|---|
| D703,290 | S * | 4/2014 | Mora | A45B 23/00 D23/213 |
| 9,010,346 | B2 * | 4/2015 | Stankiewicz | A45B 23/00 135/16 |
| 9,072,349 | B1 * | 7/2015 | Thompson | A45B 25/00 |
| 2002/0078985 | A1 * | 6/2002 | Farr | A45B 3/00 135/16 |
| 2005/0172987 | A1 * | 8/2005 | Byrnes | A45B 3/00 135/33.5 |
| 2008/0048051 | A1 * | 2/2008 | Chang | A45B 3/00 239/289 |
| 2009/0283121 | A1 * | 11/2009 | Chu | A45B 3/00 135/16 |
| 2012/0152292 | A1 * | 6/2012 | Taylor | A45B 23/00 135/16 |
| 2013/0167886 | A1 * | 7/2013 | Crain | A45B 3/04 135/16 |
| 2015/0366305 | A1 * | 12/2015 | Edwards | A45B 25/00 135/16 |

* cited by examiner

UMBRELLA WITH ENVIRONMENTAL CONTROL SYSTEMS

FIELD OF THE INVENTION

The present invention relates generally to an umbrella. More specifically, the present invention relates to an umbrella that uses fans, heating elements, and water sprayers to modify a localized environment.

BACKGROUND OF THE INVENTION

Traditional umbrellas are useful tools for keeping the sun and rain off of a user. These devices enable the user to create a localized environment that is somewhat undisturbed by external weather changes. While these devices protect from rain and sun, they do not adequately address the temperature control needs of a user on excessively hot or cold days. There are canopy systems that mist water to provide relief on hot days. Additionally, there are other canopy devices that have included heating elements to provide heat for the user on cold days. However, these systems are often not portable and designed to serve a single purpose: either heating or cooling The present invention addresses the above-described shortcomings of canopy systems that are designed to modify a localized environment. To accomplish this, the present invention is a portable umbrella that combines a heating system with a fan system and a water misting system. The combination of these systems provides the user with a device that can create an enjoyable localized environment on both hot and cold days. The present invention gives the user the option to selectively activate the fan system, the heating system, or the water misting system. As such, the user is given the option to turn the fan system on while misting water to create a cool breeze. Conversely, the user is able to turn the fan system and the heating system on, simultaneously, to blow hot air. The present invention can also be used as a device to increase the comfort and vitality of users with an active lifestyle.

DETAIL DESCRIPTIONS OF THE INVENTION

All illustrations of the drawings are for the purpose of describing selected versions of the present invention and are not intended to limit the scope of the present invention.

As can be seen in FIG. 1 through FIG. 8, the preferred embodiment of the present invention, the umbrella with environmental control systems, is an apparatus that enables a user to modify the local environment beneath the canopy of an umbrella. This is accomplished by integrating spray nozzles, fans, and heating elements into the umbrella so that the user is able to selectively heat or cool themselves. The present invention is able to mist water onto themselves on hot days. Additionally, the user is able to activate multiple fans to create a localized breeze that cools the user on hot days. Finally, the present invention is intended to increase the comfort of the user in multiple temperatures. To that end, the present invention makes use of the heating elements to increase the local temperature beneath the umbrella canopy. Thus, the present invention enables the user to remain comfortable on hot days, cold, days, sunny days, and rainy days.

Figure 1:
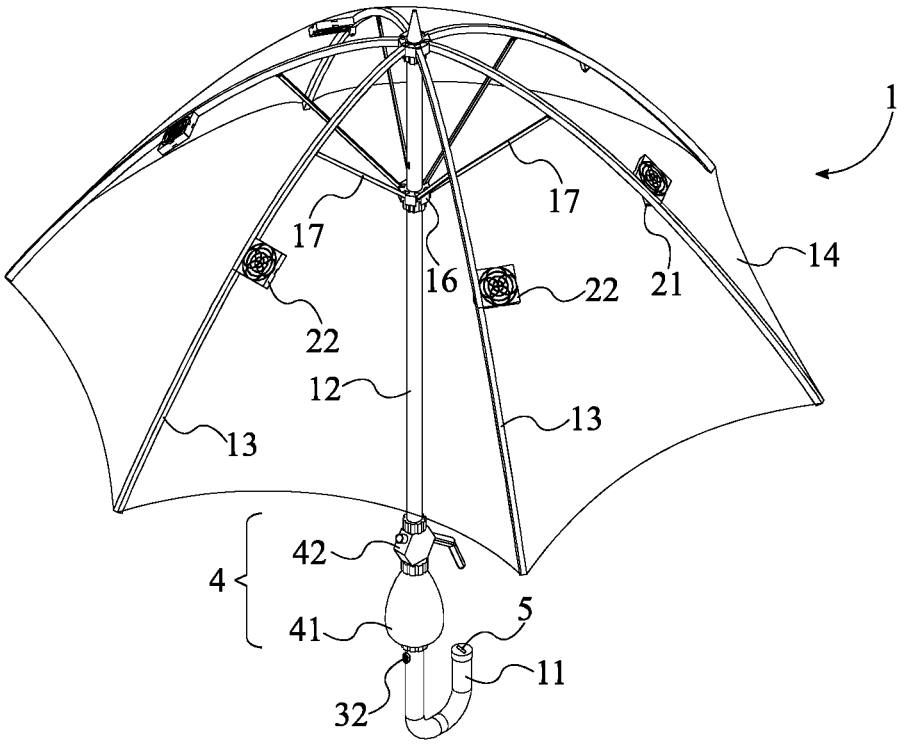
FIG. 1 is a perspective view of the present invention where the canopy is a transparent membrane.
Figure 8:
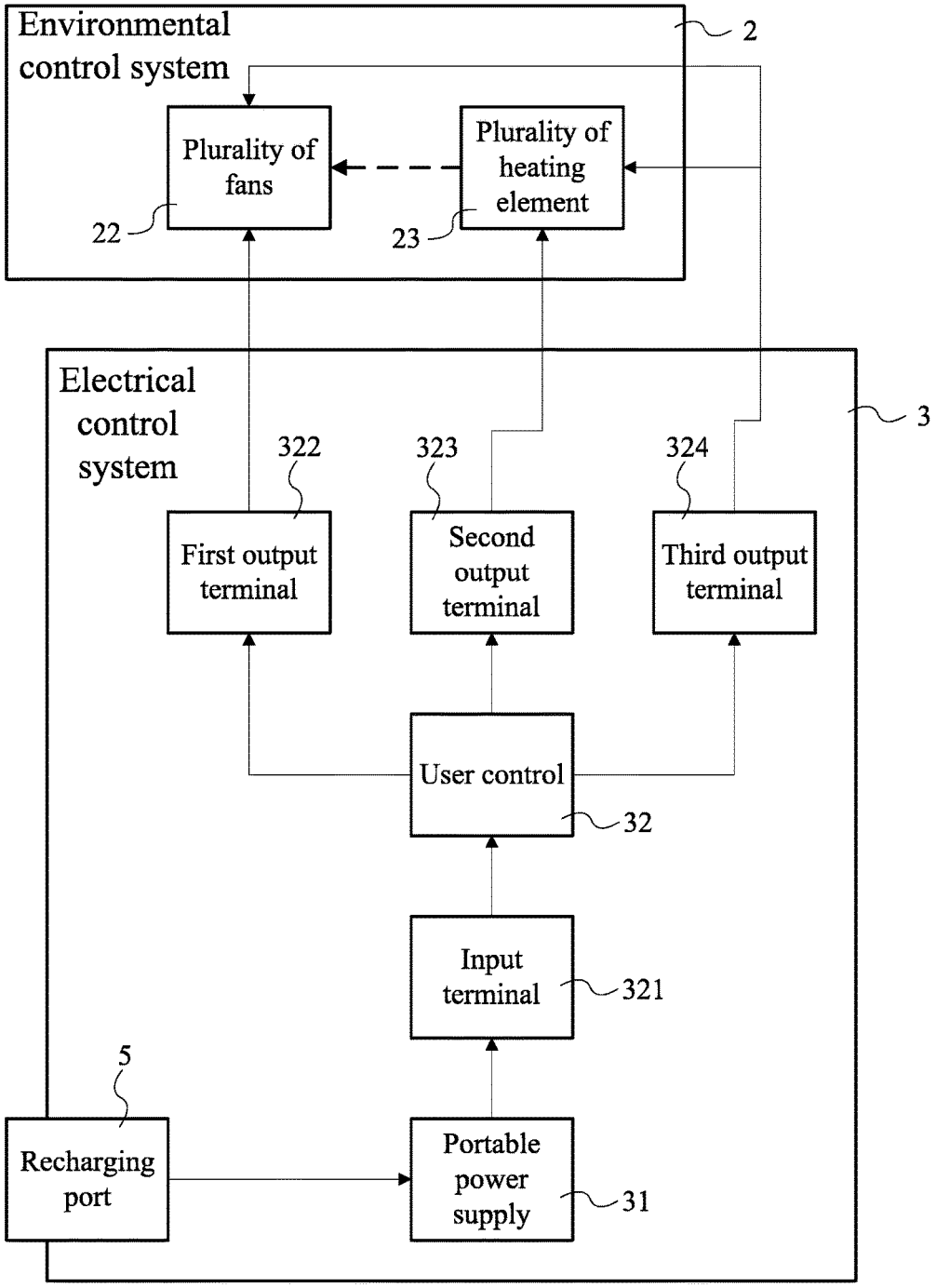
FIG. 8 is a block diagram showing the electrical connection between the components of the ECS, the recharging port, the plurality of fans, and the plurality of heating elements, where the solid arrows represent electrical connections and the dashed line represents a thermal communication.

As can be seen in FIG. 1 and FIG. 8, to accomplish the above described environmental control, the present invention comprises an umbrella 1, an environmental control system 2, an electrical control system (ESC) 3, and a fluid delivery system 4. The environmental control system 2 is a collection of, spray nozzles, fans, and heating elements that enable the user to heat or cool themselves. To accomplish this, the environmental control system 2 comprises a plurality of spray nozzles 21, a plurality of fans 22, and a plurality of heating elements 23. The umbrella 1 is the structural foundation to which the remaining components of the present invention are connected. As such, the umbrella 1 comprises a handle 11, a support rod 12, a plurality of rib members 13, and a canopy 14. The handle 11 is an ergonomically shaped device that is grasped by the user. The plurality of rib members 13 is a collection of rigid members that form the structural support of the umbrella's 1 canopy 14. The support rod 12 is a rigid pole that extends between the handle 11 and the plurality of rib members 13. Accordingly, the handle 11 is terminally attached to the support rod 12. Additionally, the plurality of rib members 13 is terminally and hingedly mounted onto the support rod 12, opposite to the handle 11. As a result, the support rod 12 maintains the plurality of rib members 13 in a position that is offset from the handle 11, thus allowing the present invention to function as an umbrella. Furthermore, the hinged connection between the plurality of rib members 13 and the support rod 12 enables the umbrella 1 to collapse and expand as the user desires.

As can be seen in FIG. 1, the present invention is designed to form a protective semi-hemispherical enclosure that protects the user from the sun and the rain. As such, the canopy 14 is a flexible piece of material that is preferably water-impermeable. The plurality of rib members 13 is radially distributed about the support rod 12. Finally, the canopy 14 is mounted across the plurality of rib members 13. Consequently, the plurality of rib members 13 enables the canopy 14 to become expanded or collapsed as the user desires.

Figure 6:
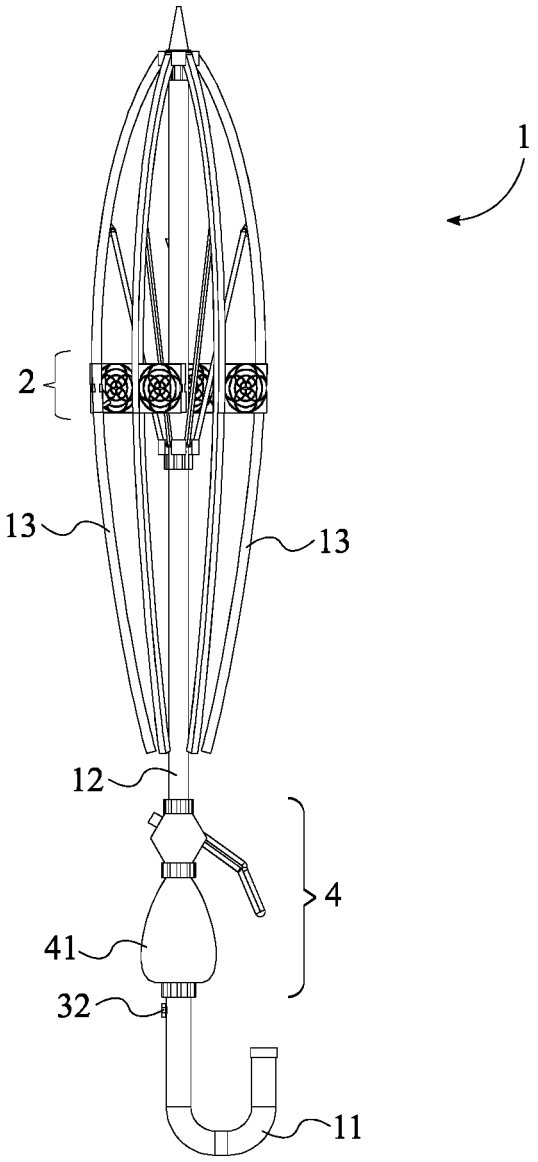
FIG. 6 is a left-side view of the present invention where the plurality of rib members is in a collapsed configuration.

As can be seen in FIG. 1 and FIG. 6, the present invention enables the user to modify the local environment beneath the canopy 14. To accomplish this, the environmental control system 2 is positioned within the canopy 14. Additionally, the environmental control system 2 is mounted onto the plurality of rib members 13. Thus positioned, the environmental control system 2 is used to heat or cool the area beneath the canopy 14. Additionally, the environmental control system 2 is able to mist water onto the user.

As can be seen in FIG. 1 and FIG. 8, the present invention employs the ECS 3 to enable the user to control the electrical functions of the plurality of fans 22 and the plurality of heating elements 23. To that end, the ECS 3 is integrated into the handle 11. Thus positioned, the ECS 3 is easily manipulated by the user's hand while grasping the handle 11. Additionally, each of the plurality of fans 22 and each of the plurality of heating elements 23 are electrically connected to the ECS 3. As a result, the ECS 3 is able to turn the plurality of fans 22 and the plurality of heating elements 23 on or off as the user desires.

Figure 3:
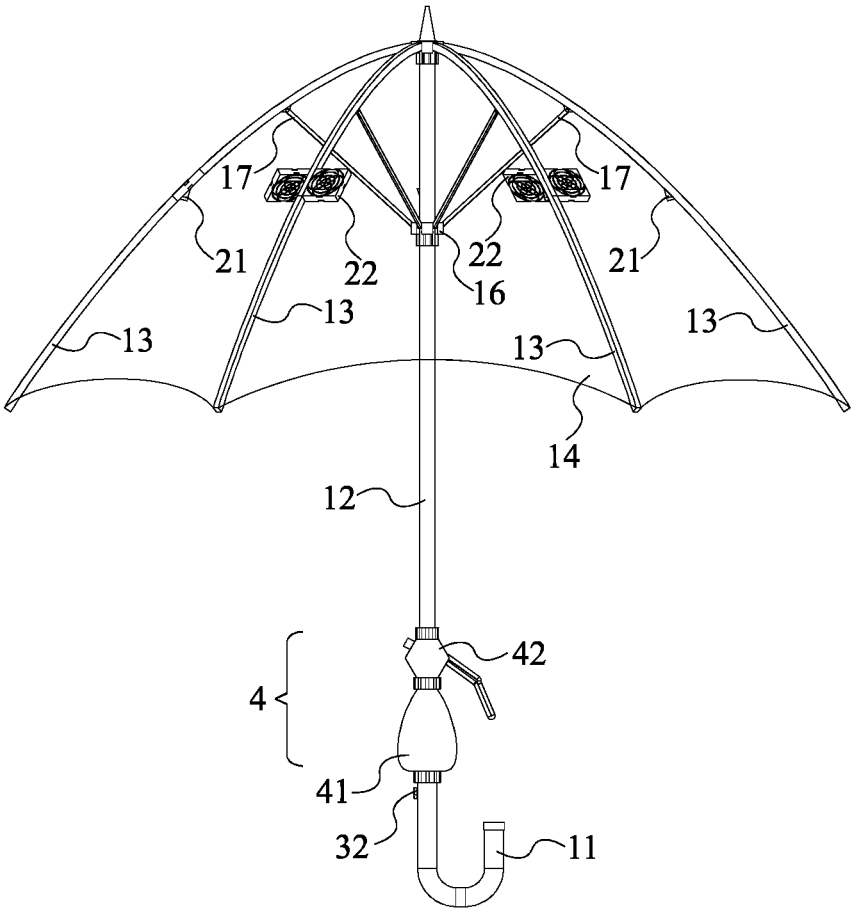
FIG. 3 is a left-side view of the present invention.

As can be seen in FIG. 3, the present invention uses mists of water as well as electrical components to modify the environment beneath the canopy 14. To accomplish this, the fluid delivery system 4 is a collection of components that supply water to the plurality of spray nozzles 21. The fluid delivery system 4 is mounted onto the support rod 12, adjacent to the handle 11 so that the user is able to easily start or stop the flow of water to the plurality of spray nozzles 21. Furthermore, each of the plurality of spray nozzles 21 is in fluid communication with the fluid delivery system 4. Accordingly, the fluid delivery system 4 is able to supply the flow of water that is misted onto the user through each of the plurality of spray nozzles 21.

Figure 7:
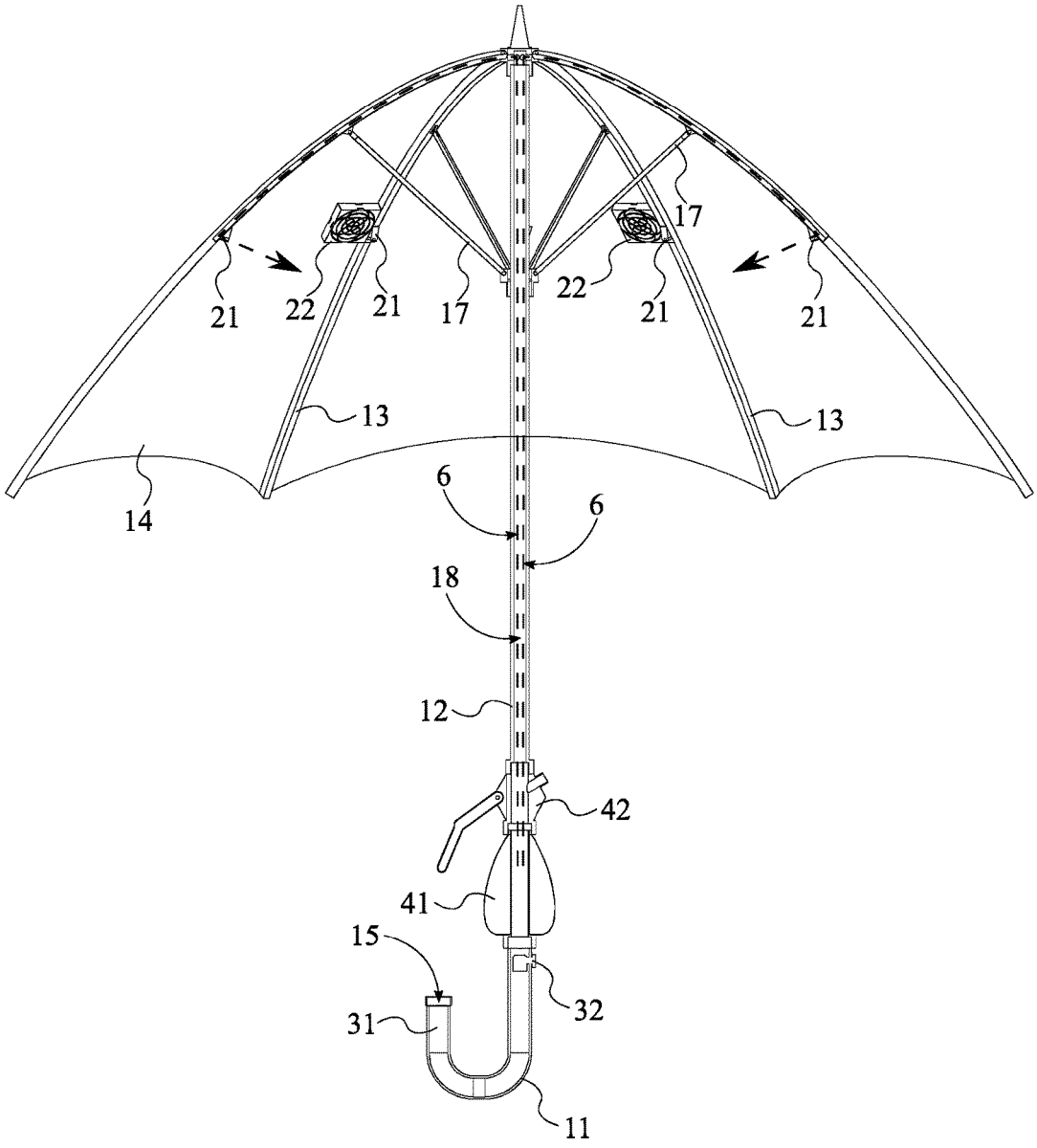
FIG. 7 is a sectional view of the present invention taken along line 7-7 in FIG. 2 where the dashed lines represent the plurality of hoses and the flow of water from the fluid reservoir, through the hand pump, and out of the plurality of spray nozzles.

As can be seen in FIG. 1, FIG. 7, and FIG. 8, the user is able to select the type of environmental modification that takes place by interacting with the ECS 3. To facilitate this, the ECS 3 comprises a portable power source 31 and a user control 32. The portable power source 31 is a power supplying device including, but not limited to, a rechargeable battery, a fuel cell, or an electrical generator. The portable power source 31 is housed within the handle 11 so that the portable power source 31 is isolated from the external environment. The user control 32 is a user interface device that enables the user to selectively activate the plurality of fans 22 and the plurality of heating elements 23. As such, the user control 32 is externally mounted onto the handle 11. Thus positioned, the user control 32 can be easily manipulated by the fingers of the user grasping the handle 11. The user control 32 is a user interface device including, but not limited to, a rocker switch, a plurality of buttons, or a touchscreen interface. The portable power source 31 is electrically connected to each of the plurality of heating elements 23 and each of the plurality of fans 22 through the user control 32. As a result, the user control 32 functions as the switch used to selectively open or close the circuit between the plurality of fans 22, the plurality of heating elements 23, and the portable power source 31. The umbrella 1 further comprises an openable compartment 15. The openable compartment 15 is an enclosure used to house the portable power source 31. The openable compartment 15 is integrated into the handle 11. Additionally, the portable power source 31 is positioned within the openable compartment 15. As a result, the portable power source 31 can be accessed and removed by opening the openable compartment 15.

As can be seen in FIG. 1 and FIG. 8, in the preferred embodiment of the present invention, the user control 32 is a multiway switch. The multiway switch enables the user to select whether to turn on the plurality of fans 22, the plurality of heating elements 23, or both. As such, the user control 32 comprises an input terminal 321, a first output terminal 322, a second output terminal 323, and a third output terminal 324. The input terminal 321 is electrically connected to the portable power source 31 so that electrical current can be supplied to the user control 32. The first output terminal 322 is electrically connected to the plurality of fans 22. As a result, the first output terminal 322 is able to supply electrical current to the plurality of fans 22 if the user desires. The second output terminal 323 is electrically connected to the plurality of heating elements 23. Accordingly, the second terminal is able to supply electrical current to the plurality of heating elements 23 if the user desires. Finally, the third output terminal 324 is electrically connected to the plurality of fans 22 and the plurality of heating elements 23. Thus connected, the user control 32 is able to supply electrical current to the plurality of fans 22 and the plurality of heating elements 23 if the user desires. The present invention further comprises a recharging port 5. The recharging port 5 is an electrical terminal that enables the ECS 3 to be connected to an external power supply. The recharging port 5 is terminally integrated into the handle 11, opposite to the support rod 12. Additionally, the recharging port 5 is electrically connected to the portable power source 31. Consequently, the user is able to connect the portable power source 31 to the external power supply.

Figure 4:
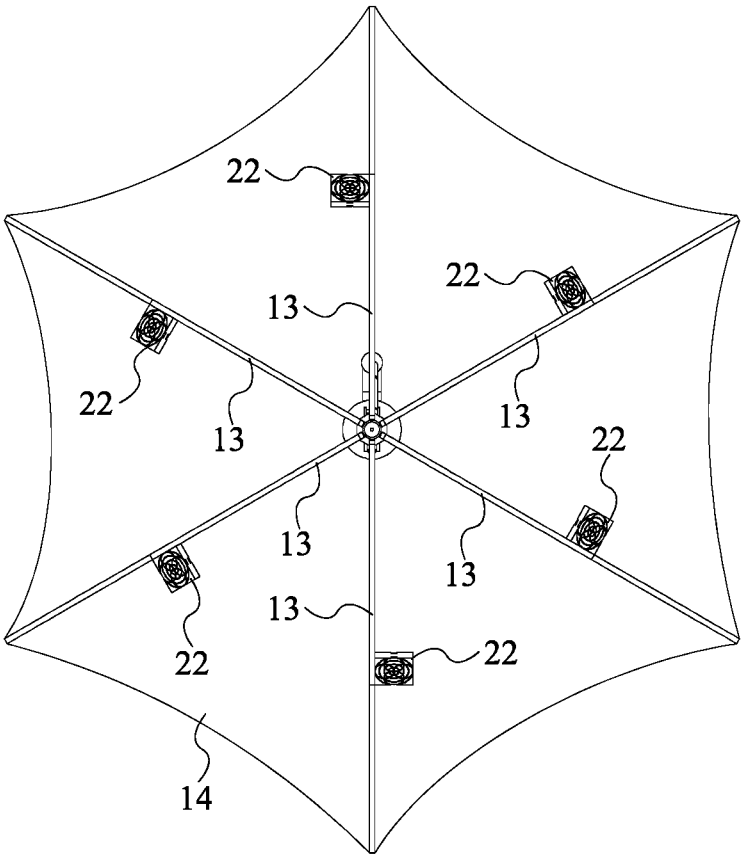
FIG. 4 is a top-side view of the present invention.
Figure 5:
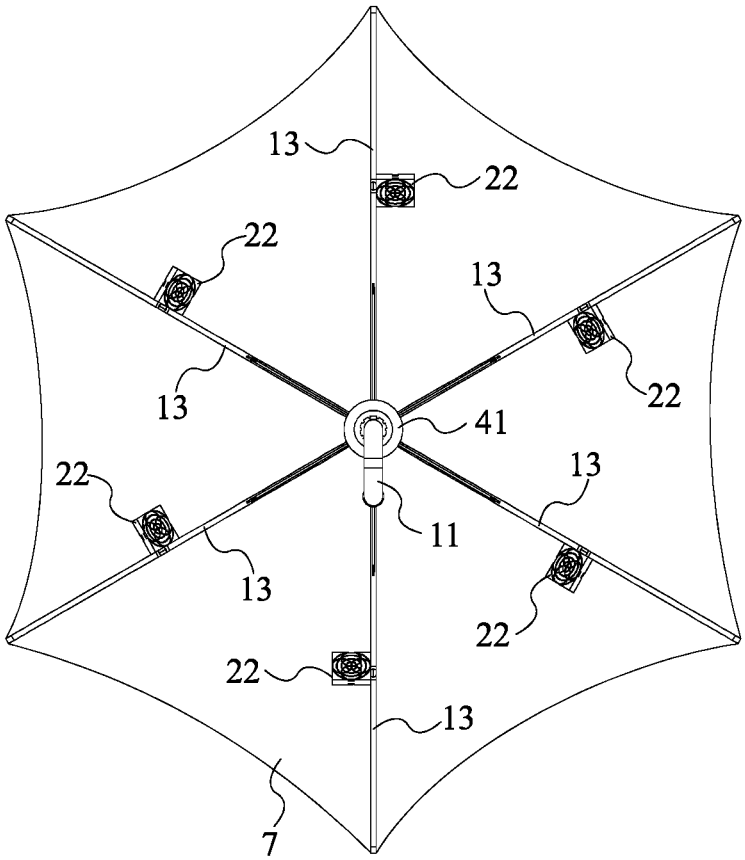
FIG. 5 is a bottom view of the present invention.

As can be seen in FIG. 1, FIG. 4, and FIG. 5, the fluid delivery system 4 is a refillable pumping system that supplies water to the plurality of spray nozzles 21. To accomplish this, the fluid delivery system 4 comprises a hand pump 42 and a fluid reservoir 41. The hand pump 42 is a hand operated pumping device that extracts water out of the fluid reservoir 41 and then delivers the water to plurality of spray nozzles 21. To accomplish this, the hand pump 42 is laterally mounted to the support rod 12 so that the user is able to easily actuate the hand pump 42 while grasping the handle 11. The fluid reservoir 41 is detachably and laterally mounted to the support rod 12. Furthermore, the fluid reservoir 41 is detachably and laterally mounted to the support rod 12. Thus affixed, the fluid reservoir 41 can be easily removed and filled as the user desires. In a first alternative embodiment, the fluid reservoir 41 is a bottle that has a centrally located channel through which the support rod 12 runs. In a second alternative embodiment, the fluid reservoir 41 is a bottle that is mounted offset from a lateral surface of the support rod 12. Finally, each of the plurality of spray nozzles 21 is in fluid communication with the fluid reservoir 41 through the hand pump 42. As a result, the user is able to draw water out of the fluid reservoir 41 by actuating the hand pump 42 and then discharge the water through each of the plurality of spray nozzles 21. The hand pump 42 is preferably a reciprocating or lever-action pump.

Figure 2:
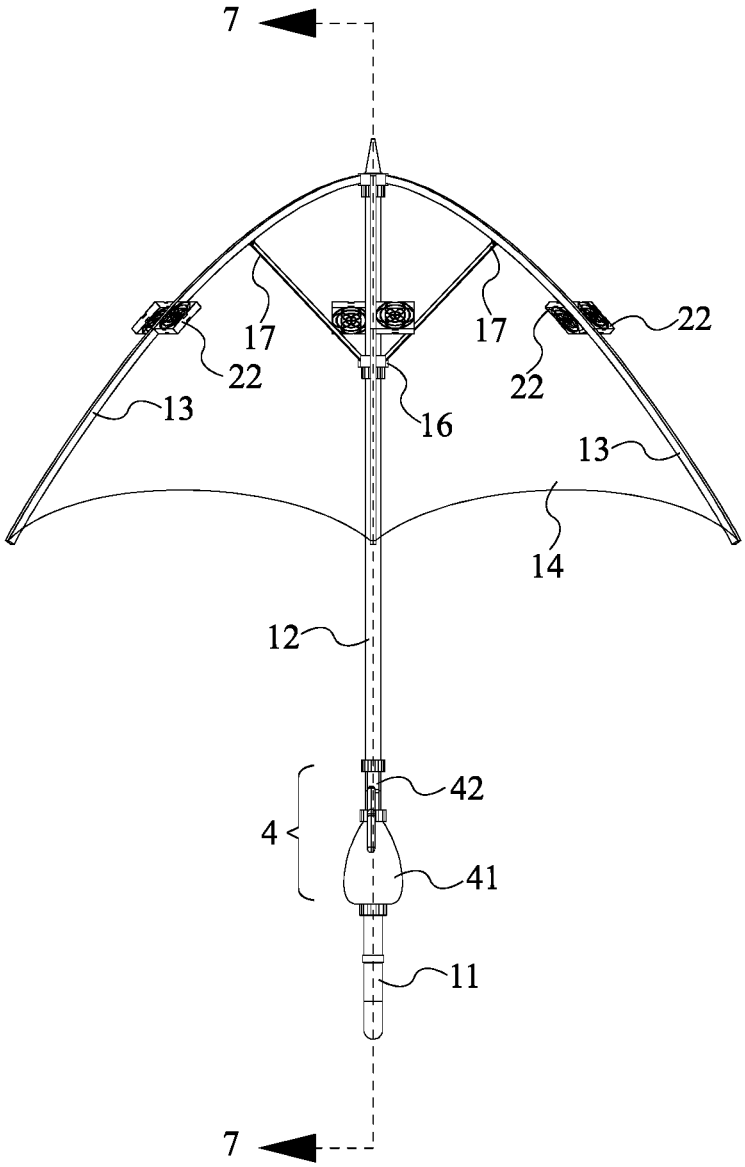
FIG. 2 is a front view of the present invention.

As can be seen in FIG. 2 and FIG. 7, the present invention is designed to look similar to an unmodified umbrella. As such the fluid connections and the electrical wiring are hidden within the support rod 12. The present invention comprises a plurality of hoses 6 that are used to connect the plurality of spray nozzles 21 to the fluid reservoir 41. To facilitate hiding the plurality of hoses 6, the umbrella 1 further comprises a connection channel 18. The connection channel 18 traverses through the support rod 12. Additionally, the connection channel 18 is positioned along the support rod 12. Consequently, the connection channel 18 turns the support rod 12 into a hollow tube.

As can be seen in FIG. 1, FIG. 4, and FIG. 7, to further specify the arrangement of the plurality of spray nozzles 21, each of the plurality of spray nozzles 21 is laterally mounted to a corresponding rib member from the plurality of rib members 13. Thus positioned, the plurality of spray nozzles 21 is oriented to direct water mists toward the user from multiple angles. Moreover, each of the plurality of spray nozzles 21 is in fluid communication with the fluid delivery system 4 through a corresponding hose from the plurality of hoses 6. Accordingly, each of the plurality of spray nozzles 21 is supplied with water by a dedicated corresponding hose. Furthermore, the corresponding hose traverses out of the connection channel 18 and along the corresponding rib member so that each of the plurality of hoses 6 is hidden within the support rod 12. In a third alternative embodiment, the corresponding hose runs through the corresponding rib member before connecting to each of the plurality of spray nozzles 21. In this way, the plurality of hoses 6 is completely hidden from view.

As can be seen in FIG. 5 and FIG. 8, the present invention is designed to function as a localized environmental modification system that facilitates user comfort. As such, the present invention comprises a heat-reflective material 7. The heat-reflective material 7 is a material that forms a thermal barrier to prevent heat transmission. The heat-reflective material 7 is superimposed onto the canopy 14 so that the heat from the plurality of heating elements 23 is unable to pass through the canopy 14. Additionally, the heat-reflective material 7 is positioned in between the canopy 14 and the plurality of rib members 13. Thus positioned, the heat-reflective material 7 directs the heat generated by the plurality of heating elements 23 toward the support rod 12 and the user. To further the benefits gained by the heat-reflective material 7, each of the plurality of heating elements 23 is in thermal communication with a corresponding fan from the plurality of fans 22. Consequently, the corresponding fan blows the heated air generated by each of the plurality of heating elements 23 toward the user. Additionally, each of the plurality of heating elements 23 is radially distributed about the support rod 12. Thus positioned, the plurality of heating elements 23 is able to evenly heat the area beneath the canopy 14. Similarly, each of the plurality of fans 22 is radially distributed about the support rod 12. Accordingly, the plurality of fans 22 is able to blow air toward the user from multiple directions.

As can be seen in FIG. 1 and FIG. 3, the present invention is designed to expand and collapse to be easily deployed or stored. To accomplish this, the umbrella 1 further comprises a runner 16 and a plurality of stretchers 17. The runner 16 is an annular carriage that the user is able to move along the support rod 12. Specifically, the runner 16 is slidably connected along the support rod 12. Consequently, the user is able to transition the present invention between a collapsed configuration and an expanded configuration by moving the runner 16 along the length of the support rod 12. Each of the plurality of stretchers 17 is a rigid beam that serves as a linkage between the runner 16 and the plurality of rib members 13. To that end, the plurality of stretchers 17 is radially distributed about the support rod 12. Additionally, the runner 16 is terminally and hingedly connected to each of the plurality of stretchers 17. Furthermore, each of the plurality of rib members 13 is terminally and hingedly connected to a corresponding stretcher from the plurality of stretchers 17, opposite to the runner 16. As a result, the sliding motion of the runner 16 along the support rod 12 is transferred through the plurality of stretchers 17 into the plurality of rib members 13. For example, when the user moves the runner 16 away from the handle 11, the plurality of rib members 13 is extended and the present invention is transitioned into the expanded configuration. Conversely, when the user moves the runner 16 toward the handle 11, the plurality of rib members 13 is retracted and the present invention is transitioned into the collapsed configuration.

Although the invention has been explained in relation to its preferred embodiment, it is to be understood that many other possible modifications and variations can be made without departing from the spirit and scope of the invention as hereinafter claimed.

I claim:

1. An umbrella comprising:

a canopy;

a plurality of rib members forming structural support to the canopy;

a handle;

a support rod extending between the handle and the plurality of rib members, wherein the plurality of rib members is terminally and hingedly mounted onto the support rod, and wherein the plurality of rib members is radially distributed about the support rod;

an environmental control system, positioned beneath the canopy on the plurality of rib members, comprises a plurality of spray nozzles, a plurality of fans, and a plurality of heating elements;

an electrical control system (ECS) integrated within the handle, wherein each of the plurality of fans and each of the plurality of heating elements of the environmental control system are electrically connected to the ECS, wherein the ECS comprises a user control and a recharging port to be electrically connected with at least one of an external power supply and a portable power supply;

a fluid delivery system comprising a hand pump and a fluid reservoir, wherein the fluid delivery system is detachably and laterally mounted onto the support rod, and wherein each of the plurality of spray nozzles is in fluid communication with the fluid reservoir through the hand pump;

a heat-reflective material, wherein the heat-reflective material is superimposed onto the canopy; and the heat-reflective material being positioned in between the canopy and the plurality of rib members;

wherein the user control is a multiway switch comprising an input terminal, a first output terminal, a second output terminal, and a third output terminal, and wherein the input terminal is electrically connected to the portable power source, the first output terminal is electrically connected to the plurality of fans, the second output terminal is electrically connected to the plurality of heating elements; and the third output terminal is electrically connected to the plurality of fans and the plurality of heating elements;

wherein the recharging port is terminally integrated into the handle and electrically connected to the portable power source, and wherein an openable compartment is integrated into the handle, wherein the portable power source is enclosed within the openable compartment.

2. The umbrella with environmental control systems as claimed in claim 1, wherein the portable power source is housed within the handle, and is electrically connected to each of the plurality of heating elements and each of the plurality of fans through the user control;

and wherein the user control is externally mounted onto the handle.

3. The umbrella with environmental control systems as claimed in claim 1, wherein the pump being a reciprocating pump.

4. The umbrella with environmental control systems as claimed in claim 1, further comprising:

a plurality of hoses; and a connection channel traversing through the support rod, and positioned along the support rod;

wherein each of the plurality of spray nozzles is laterally mounted to a corresponding rib member from the plurality of rib members;

and wherein each of the plurality of spray nozzles is in fluid communication with the fluid delivery system through a corresponding hose from the plurality of hoses; and wherein the corresponding hose traverses out of the connection channel and along the corresponding rib member.

5. The umbrella with environmental control systems as claimed in claim 1, wherein each of the plurality of heating elements is in thermal communication with a corresponding fan from the plurality of fans.

6. The umbrella with environmental control systems as claimed in claim 1, wherein each of the plurality of heating elements is radially distributed about the support rod.

7. The umbrella with environmental control systems as claimed in claim 1, wherein each of the plurality of fans is radially distributed about the support rod.

8. The umbrella with environmental control systems as claimed in claim 1, further comprising:

a runner and a plurality of stretchers; the runner being slidably connected along the support rod;

the plurality of stretchers being radially distributed about the support rod; each of the plurality of stretchers being terminally and hingedly connected to the runner; and each of the stretchers being terminally and hingedly connected to a corresponding rib member from the plurality of rib members, opposite to the runner.

* * * * *